US008250866B2

(12) United States Patent
Styles et al.

(10) Patent No.: US 8,250,866 B2
(45) Date of Patent: Aug. 28, 2012

(54) EGR EXTRACTION IMMEDIATELY DOWNSTREAM PRE-TURBO CATALYST

(75) Inventors: Daniel Joseph Styles, Canton, MI (US); Christopher Oberski, Plymouth, MI (US); Christopher Cowland, Dexter, MI (US); Patrick Sexton, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 434 days.

(21) Appl. No.: 12/512,483

(22) Filed: Jul. 30, 2009

(65) Prior Publication Data

US 2011/0023482 A1 Feb. 3, 2011

(51) Int. Cl.
*F02B 33/44* (2006.01)

(52) U.S. Cl. ..... 60/605.2

(58) Field of Classification Search ..... 60/605.2, 60/612, 302, 280
See application file for complete search history.

(56) References Cited

U.S. PATENT DOCUMENTS

| | | | | |
|---|---|---|---|---|
| 5,791,146 | A * | 8/1998 | Dungner | 60/605.2 |
| 5,794,445 | A * | 8/1998 | Dungner | 60/605.2 |
| 6,474,060 | B2 | 11/2002 | Khair | |
| 6,598,388 | B2 | 7/2003 | Lucas et al. | |
| 6,739,125 | B1 * | 5/2004 | Mulligan | 60/286 |
| 6,951,098 | B2 * | 10/2005 | Xu et al. | 60/286 |
| 6,973,787 | B2 * | 12/2005 | Klingel | 60/612 |
| 6,981,375 | B2 | 1/2006 | Sisken et al. | |
| 6,988,365 | B2 | 1/2006 | Sasaki | |
| 7,000,393 | B1 * | 2/2006 | Wood et al. | 60/605.2 |
| 7,047,933 | B2 | 5/2006 | Gray, Jr. | |
| 7,165,403 | B2 * | 1/2007 | Sun et al. | 60/612 |
| 7,299,793 | B1 | 11/2007 | Tyo et al. | |
| 7,461,641 | B1 | 12/2008 | Styles et al. | |
| 7,490,462 | B2 * | 2/2009 | Roozenboom et al. | 60/278 |
| 8,176,737 | B2 * | 5/2012 | Pierpont et al. | 60/605.2 |
| 2005/0172613 | A1 | 8/2005 | Blomquist | |
| 2005/0229900 | A1 * | 10/2005 | Weber et al. | 123/316 |
| 2005/0274366 | A1 * | 12/2005 | Sato | 123/568.2 |
| 2006/0096275 | A1 * | 5/2006 | Robel et al. | 60/286 |
| 2006/0174621 | A1 * | 8/2006 | Chen et al. | 60/612 |
| 2007/0130946 | A1 * | 6/2007 | Winsor et al. | 60/605.1 |
| 2007/0214771 | A1 | 9/2007 | Freitag et al. | |
| 2007/0289289 | A1 * | 12/2007 | Kojima et al. | 60/280 |
| 2008/0000228 | A1 * | 1/2008 | Kieser | 60/605.1 |
| 2008/0115492 | A1 * | 5/2008 | Freese V | 60/605.2 |
| 2008/0307788 | A1 * | 12/2008 | Hokuto | 60/624 |
| 2009/0217645 | A1 * | 9/2009 | Sisken et al. | 60/286 |

OTHER PUBLICATIONS

Brendan Carberry, et al. "Pre-Turbocharger Catalyst—Fast catalyst light-off evaluation", 2005-01-2142, © 2005 SAE International.
Volker Joergl, et al. "Influence of Pre Turbo Catalyst Design on Diesel Engine Performance, Emissions and Fuel Economy", 2008-01-0071, Reprinted from: Diesel Exhaust Emission Control, 2008 (SP-2154), SAE International, 2008 World Congress, Detroit, Michigan, Apr. 14-17, 2008.

* cited by examiner

*Primary Examiner* — Thomas Denion
*Assistant Examiner* — Cameron Setayesh
(74) *Attorney, Agent, or Firm* — Julia Voutyras; Alleman Hall McCoy Russell & Tuttle LLP

(57) ABSTRACT

A turbocharged, diesel engine has a small catalyst provided upstream of the turbocharger with EGR collected from the exhaust stream downstream of the catalyst and upstream of the turbocharger. By making the catalyst small, it packages into a pipe coupling the manifold to the turbocharger, readily reaches lightoff, and absorbs little exhaust energy, thereby providing acceptable conversion of hydrocarbons and CO, but still allowing fast turbocharger response. In one embodiment, the engine has two cylinder banks, two exhaust manifolds, and two pre-turbo catalysts installed upstream of the turbine.

12 Claims, 4 Drawing Sheets

EGR EXTRACTION IMMEDIATELY DOWNSTREAM PRE-TURBO CATALYST

BACKGROUND

1. Technical Field

The present development relates to EGR routing and configuration of aftertreatment devices for a turbocharged diesel engine.

2. Background

Diesel engine exhaust is generally cooler than exhaust from a gasoline engine because the diesel engine operates with excess air and the cycle is more efficient at most operating conditions, which means there is less rejection of energy to exhaust gases. It is generally desirable to mount the turbine of the turbocharger close to the exhaust manifold so that exhaust energy, which is extracted by the turbine, is at its highest level. Turbocharger lag is partially mitigated by having the turbine located as close to the engine as possible. It is also known that exhaust aftertreatment devices, such as DOCs (diesel oxidation catalysts) and SCR (selective-catalyst reduction) catalysts, operate more efficiently when in a preferred temperature range. In particular, it is important for aftertreatment devices to attain their lightoff temperature as soon as possible following a cold start of the engine. Thus, it is desirable for quick lightoff to place aftertreatment devices as close to the engine as possible so that the aftertreatment devices can process exhaust gases soon after an engine cold start.

SUMMARY

According to an embodiment of the present disclosure, a multiple-cylinder engine has an exhaust manifold which directs engine exhaust into a pipe leading to the turbocharger; the pipe has a small catalyst fitted within. Inserting the small catalyst into the pipe obviates the need for an additional can that a full-sized close-coupled catalyst would require, which would also entail complicated and bulky plumbing and additional connections. By having a small volume, the catalyst attains its operating temperature rapidly and extracts little energy from the exhaust gases to attain its operating temperature, thereby interfering minimally with supplying exhaust energy directly to the turbine section of the turbocharger. Furthermore, pressure drop across a small catalyst can be minimized by controlling the aspect ratio of the can. The pipe housing the catalyst has an EGR (exhaust gas recirculation) outlet port to provide EGR to the EGR system, which includes: an EGR tube connecting the engine exhaust to the engine intake, EGR valve, and EGR cooler. EGR is extracted upstream of the turbocharger, thus, at high pressure.

According to another embodiment, the engine has first and second banks of cylinders, which exhaust to first and second exhaust manifolds, respectively. First and second pipes having first and second catalysts are coupled to the first and second manifolds, respectively, to receive the exhaust gases from the cylinder banks. The turbocharger has first and second turbines on a single shaft supplied exhaust gases through first and second exhaust inlets, which are coupled to the first and second pipes, respectively. Only the first pipe has an EGR outlet port so that the first turbine receives the exhaust gases from the first bank of engine cylinders less what is supplied to the EGR system. The second turbine receives substantially all flow from the second bank of cylinders.

In one embodiment, the catalyst is a DOC (diesel oxidation catalyst), which primarily oxidizes unburned hydrocarbons and CO (carbon monoxide). By having a small DOC arranged upstream of the turbocharger, the emissions of hydrocarbons and CO from the tailpipe can be reduced by about half at some operating conditions. Higher conversion efficiencies are achievable with a larger catalyst; however, with concomitant disadvantages of higher back pressure and packaging complications. Another tradeoff is that the turbines extract less energy, thus overall efficiency is harmed, when the back pressure is increased.

In one embodiment, a DOC of larger volume than the pre-turbo DOC is provided in the exhaust downstream of the turbocharger. Having a DOC before the turbocharger causes the downstream DOC to attain its lightoff more quickly after engine start, due to exothermic oxidation of hydrocarbons and CO increasing exhaust temperature. Thus, the combination of a pre-turbo DOC combined with a downstream DOC act synergistically to improve conversion efficiency, particularly during cold start.

By removing the EGR stream prior to expansion in the turbocharger, the EGR is at high pressure. This allows introduction of EGR gases to the EGR system (in particular an EGR valve and EGR cooler) that have reduced HC levels, mitigating HC deposition issues such as valve sticking and cooler fouling. In some prior art systems, an EGR catalyst is provided to alleviate HC deposition. An advantage of an embodiment of the disclosed configuration is that the pre-turbo catalyst alleviates the HC deposition problem as well as providing gases with fewer HCs to the turbine of the turbocharger and causes the downstream catalyst to lightoff more readily.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to controlling turbine inlet temperature in a turbocharged, diesel engine. However, this can be applied to any system with an exhaust turbine. Those of ordinary skill in the art may recognize similar applications or implementations consistent with the present disclosure, e.g., ones in which components are arranged in a slightly different order than shown in the embodiments in the Figures. Those of ordinary skill in the art will recognize that the teachings of the present disclosure may be applied to other applications or implementations.

Figure 1:
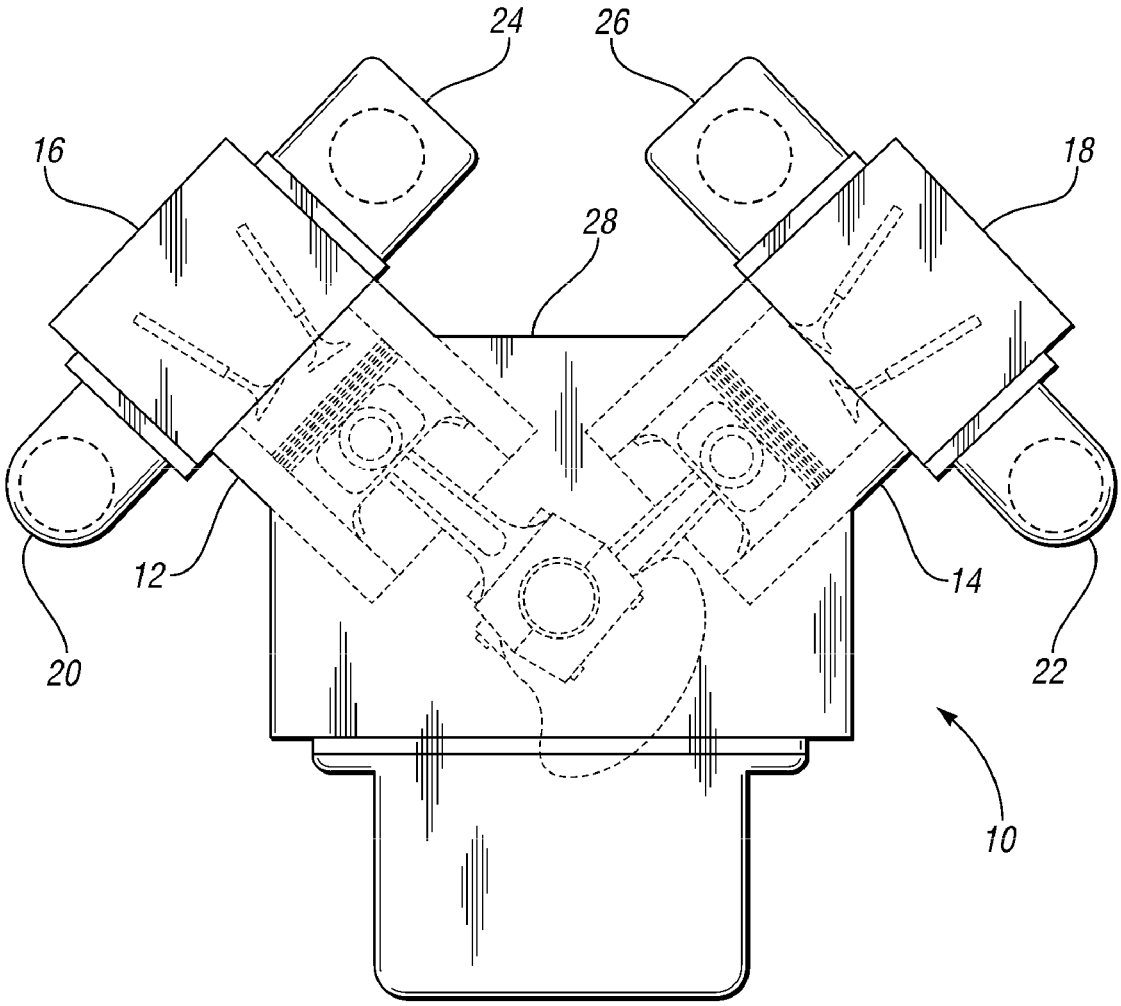
FIG. 1 is a front view of a vee engine.

Referring to FIG. 1, engine 10 is a vee engine having a first bank of cylinders 12 and a second bank of cylinders 14 which are sealed by first cylinder head 16 and second cylinder head 18, respectively. The combustion chamber is sealed off from the intake manifolds (first is 20 and second is 22) by poppet valves. The poppet valves are actuated by camshafts (not shown) to open during predetermined times to allow fresh air to enter the combustion chamber and exhaust gases to be released from the combustion chamber into first and second exhaust manifolds 24 and 26. In between the cylinder banks 12 and 14 is a valley 28.

Figures 2, 3:
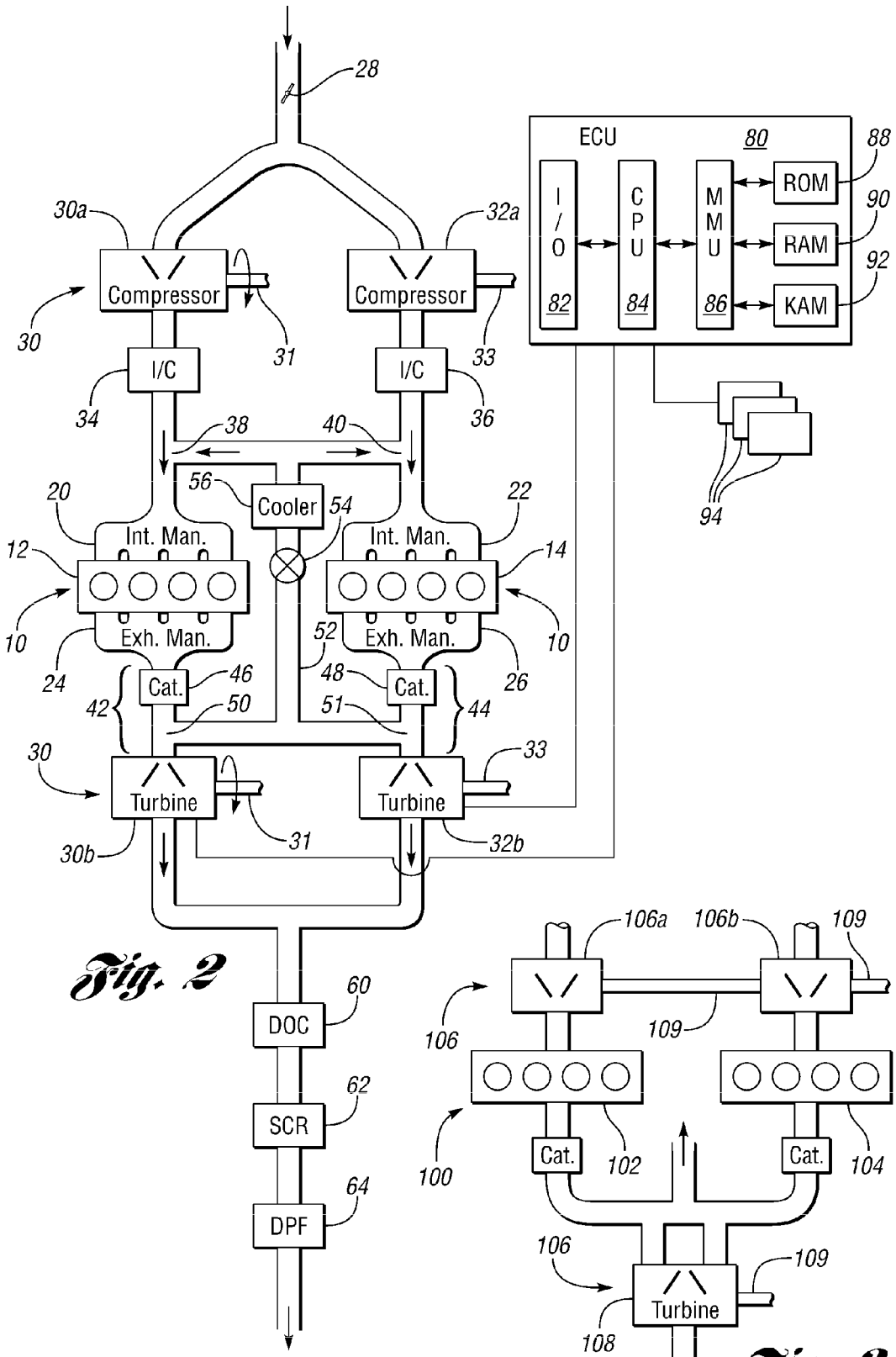
FIGS. 2-6 are schematics showing configurations for turbocharged, diesel engines according to embodiments of the disclosure.

In FIG. 2 a schematic of engine 10 is shown according to an embodiment of the present disclosure. Engine 10 is shown in FIG. 2 with first cylinder bank 12 separate from second cylinder bank 14. In reality, they are vee-configured and the separation is shown for convenience in schematically representing the layout. Fresh air flows through throttle valve 28. About half of the intake air flows to compressor 30*a* of turbocharger 30 and the rest to compressor 32*a* of turbocharger 32. Compressor 30*a* is coupled to turbine 30*b* via shaft 31. Compressor 32*a* is coupled to turbine 32*b* via shaft 33. For schematic representation purposes, the compressors and turbines are shown separated in FIG. 2.

Continuing with FIG. 2, the compressed intake gases are cooled in intercoolers 34 and 36. Prior to entering intake manifolds 12 and 14, EGR gases are mixed into the fresh air entering at EGR ports 38 and 40. The fresh gases and EGR gases enter cylinder banks 12 and 14. Fuel is directly injected into engine cylinders to initiate combustion. The exhaust gases exiting through first exhaust manifold 24 enter first pipe 42 and exhaust gases exiting through second exhaust manifold 26 enter second pipe 44. Fitted within pipes 42 and 44 are small catalysts 46 and 48, respectively. In one embodiment, catalysts 46 and 48 are DOCs. Pipe 42 has an EGR outlet port 50 coupled to an EGR tube 52 and pipe 44 has an EGR outlet port 51 coupled to EGR tube 52. As illustrated in FIG. 2, EGR gases are extracted from both pipes 42 and 44. In an alternative embodiment, there is no EGR outlet port 51, and all EGR is supplied from cylinder bank 12 through EGR outlet port 50. In another alternative, an EGR system is provided on each bank, having two EGR valves and two EGR coolers.

EGR outlet ports 50 and 51 are coupled to EGR tube 52, which has an EGR valve 54 and an EGR cooler 56 disposed therein. Alternatively, EGR cooler 56 is upstream of EGR valve 54. EGR is recirculated into the intake stream at EGR inlet ports 38 and 40.

In FIG. 2, exhaust flowing out of turbines 30*b* and 32*b* tees together before being introduced into DOC 60, SCR 62, and DPF (diesel particulate filter) 64. Alternatively, the order of the SCR and DPF is reversed. In yet another alternative, the gases flowing out of turbines 30*b* and 32*b* remain separated and each exhaust line has a DOC, SCR, and DPF.

Also shown in FIG. 2 is an electronic control unit (ECU) 80, which has an input/output (I/O) 82, a microprocessor 84, called a central processing unit (CPU), which is in communication with memory management unit (MMU) 86. MMU 86 controls the movement of data among the various computer readable storage media and communicates data to and from CPU 84. The computer readable storage media preferably include volatile and nonvolatile storage in read-only memory (ROM) 88, random-access memory (RAM) 90, and keep-alive memory (KAM) 92, for example. KAM 92 may be used to store data while CPU 84 is powered down. The computer readable storage media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by CPU 84 in controlling the engine or vehicle into which the engine is mounted. The computer readable storage media may also include floppy disks, CD-ROMs, hard disks, and the like. CPU 84 communicates with various sensors and actuators via I/O 82. In FIG. 2, ECU 80 controls throttle valve 28 and EGR valve 54. Exhaust turbines 30*c* and 30*d*, in one embodiment, are variable geometry turbines, in which case they are controlled by ECU 80. Various other sensors 94 and actuators communicate to or are controlled by ECU 80. Some ECU 80 architectures do not contain MMU 86. If no MMU 86 is employed, CPU 84 manages data and connects directly to ROM 88, KAM 90, and RAM 92. Of course, more than one CPU 84 can be used to provide engine control and ECU 80 may contain multiple ROM 88, KAM 90, and RAM 92 coupled to MMU 86 or CPU 84 depending upon the particulars of the application.

In an alternative to FIG. 2, engine 100 has cylinder banks 102 and 104. A turbocharger 106 has two compressor 106*a* and 106*b* as well as turbine 109 on a single shaft 109. The configuration of engine 100 and turbocharger 106 as separated are shown for illustration purposes.

Figure 4:
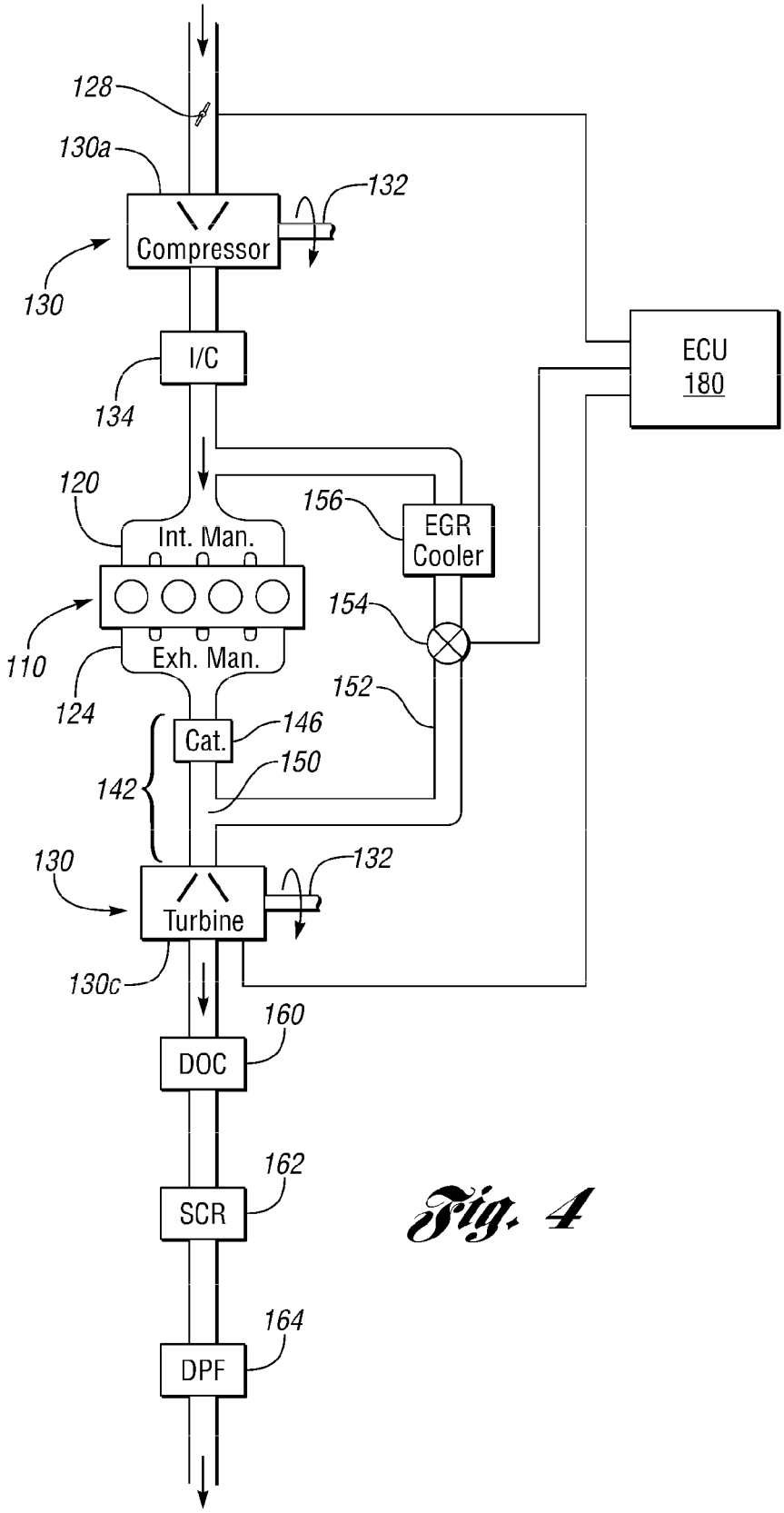

FIG. 2 shows an engine 10 with two banks 12 and 14. In FIG. 4, engine 110 has one cylinder bank 112. Engine 110 has a turbocharger 130 with one compressor 130*a* and one turbine 130*c*. Compressor 130*a* and turbine 130*c* are mechanically coupled by a shaft 132. Intake air is cooled in intercooler 134 and supplied to intake manifold 120 prior to combusting in engine cylinders. Exhaust travels to exhaust pipe 142 via exhaust manifold 124. Pipe 142 has a catalyst 146 to treat exhaust gases prior to being expanded in turbine 130*c*. Exhaust gases are further processed in DOC 160, SCR 162, and DPF 164 prior to exiting the tailpipe. EGR is supplied out of pipe 142 through EGR outlet port 150. EGR flow rate is controlled by the position of EGR valve 154. EGR gases are cooled in EGR cooler 156 prior to be introduced into the intake at EGR inlet port 138.

Figure 5:
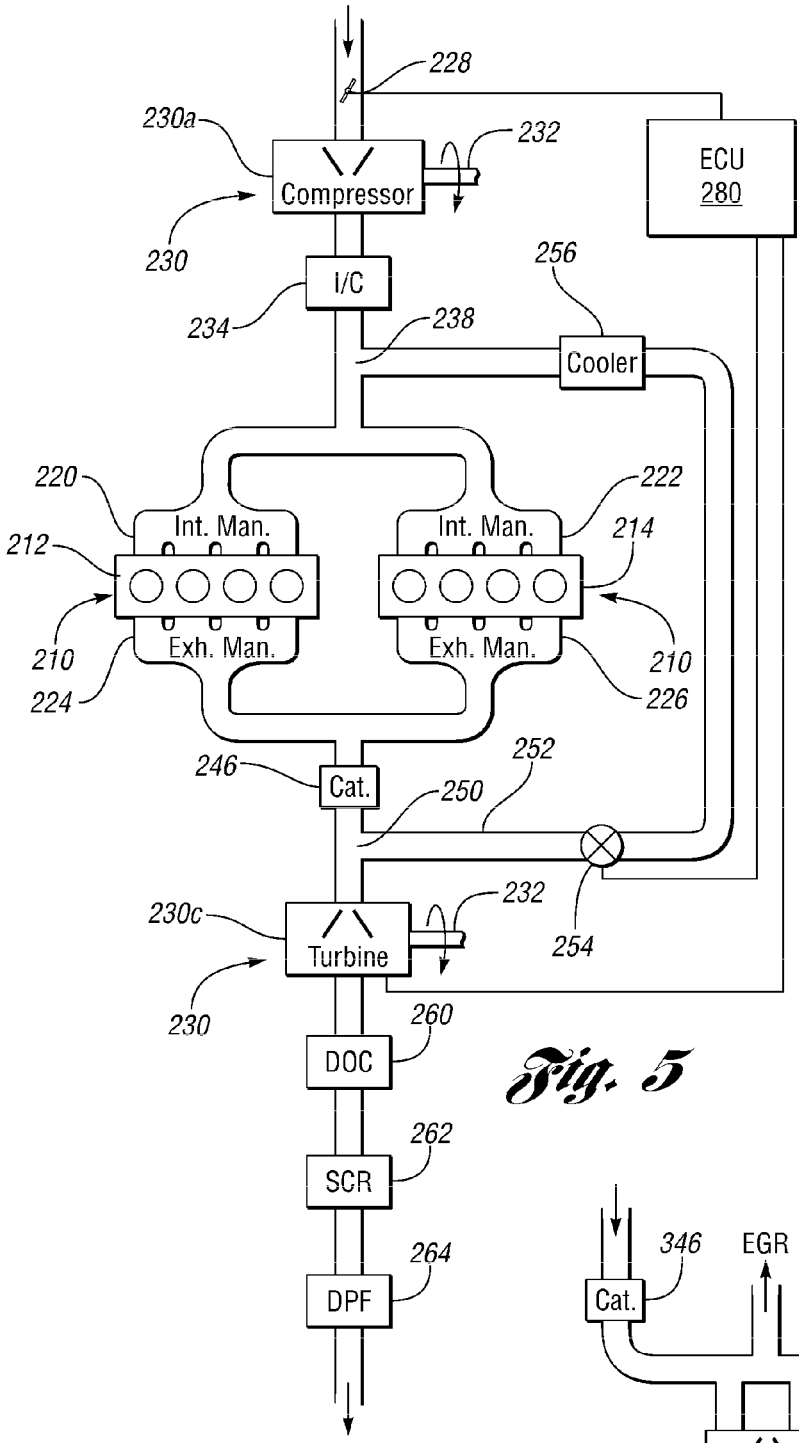

In FIG. 2, the intake tees after throttle valve 28 and the exhaust gas streams form one stream after turbines 30*b* and 32*b*. Another alternative is shown in FIG. 5 in which an engine 210 has two cylinder banks 212 and 214 that tee together so that that turbocharger 230 has a single compressor 230*a* and a single turbine 230*c* coupled via a shaft 232. In such a configuration, a single intercooler 234 and a single pre-turbine catalyst 246 are provided. ECU 280 controls EGR valve 250, variable geometry turbine 230*c*, and throttle valve 228. Compressor 230*a* and 230*c* are coupled via shaft 232. Engine 210 has two intake manifolds 220 and 222 and two exhaust manifolds 224 and 226. DOC 260, SCR 262, and DPF 264 are located downstream of turbine 230*c*.

Figure 6:
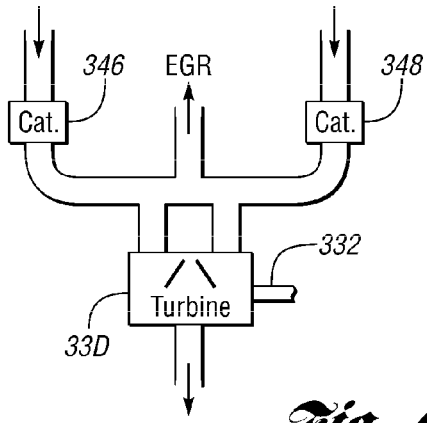

Yet another alternative is shown in FIG. 6 in which exhaust gases from two cylinder banks remain separated and pass through catalysts 346 and 348. EGR is shown in FIG. 6 as being taken off of a tee downstream of catalysts 346 and 348. Alternatively, EGR can be taken from the downstream of only one of the branches, e.g., downstream of catalyst 346. Such an alternative may obviate the need for catalyst 348. Turbine 330 which is coupled to a compressor (not shown) via shaft 332 has two inlets and one outlet.

While the best mode has been described in detail, those familiar with the art will recognize various alternative designs and embodiments within the scope of the following claims. For example in FIG. 2, the two exhaust ducts from turbines 30*c* and 30*d* tee to form one exhaust duct having one having DOC 60, SCR 62, and DPF 64. Alternatively, the two exhaust ducts could remain separated with each having a DOC, SCR, and DPF. Also several alternative configurations are shown in FIGS. 2, 3, and 4. However, many more combinations of elements shown in the Figures are possible beyond what is shown explicitly in FIGS. 2, 3, and 4. Where one or more embodiments have been described as providing advantages or being preferred over other embodiments and/or over prior art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the disclosure as claimed.

What is claimed:

1. An internal combustion engine having a first bank of cylinders and a second bank of cylinders, comprising:

a first exhaust manifold coupled to the first bank of cylinders;

a second exhaust manifold coupled to the second bank of cylinders;

a first pipe coupled to the first exhaust manifold having a first catalyst fitted within;

a second pipe coupled to the second exhaust manifold having a second catalyst fitted within;

a turbocharger having first and second exhaust inlets coupled to the first and second pipes, respectively; and an EGR port coupled to both the first and second pipes at a location downstream of the first and second catalysts, but upstream of the turbocharger.

2. The engine of claim 1, further comprising:

a first intake manifold coupled to the first bank of cylinders;

a second intake manifold coupled to the second bank of cylinders;

an EGR line coupled to the EGR port;

an EGR valve disposed in the EGR line;

a branch disposed in the EGR line downstream of the EGR valve, the branch having a first outlet supplying EGR to the first intake manifold and a second outlet supplying EGR to the second intake manifold.

3. The engine of claim 2 wherein exhaust gases passing through the EGR valve are provided exclusively from the first bank of cylinders.

4. The engine of claim 2 wherein the first and second banks are arranged in a vee configuration and the first and second intake manifolds are arranged outboard with respect to the vee.

5. The engine of claim 1 wherein the turbocharger has first and second turbines coupled to a single shaft and exhaust gases from the first bank of cylinders are directed to the first turbine and exhaust gases from the second bank of cylinders are directed to the second turbine.

6. The engine of claim 1 wherein the first and second banks are arranged in a vee configuration and the first and second exhaust manifolds are arranged in a valley of the vee.

7. The engine of claim 1 wherein the first and second catalysts are first and second diesel oxidation catalysts.

8. An internal combustion engine system having a bank of cylinders supplying fresh gases through an intake manifold and exhausting combusted gases through an exhaust manifold, the system having:

a turbocharger having a compressor disposed in a first intake duct coupled to the intake manifold and a variable geometry turbine;

an exhaust pipe coupling the exhaust manifold with an inlet of the variable geometry turbine;

a diesel oxidation catalyst fitted within the exhaust pipe; and an EGR system comprising:

an EGR outlet port in the exhaust pipe, the EGR outlet port disposed between the diesel oxidation catalyst and the variable geometry turbine, the EGR outlet port positioned downstream of the diesel oxidation catalyst and upstream of the turbine;

an EGR duct coupling the EGR outlet port with an EGR inlet port in the first intake duct;

an EGR valve disposed in the EGR duct; and an EGR cooler disposed in the EGR duct.

9. The system of claim 8, further comprising:

an exhaust duct coupled to an outlet of the turbine;

a downstream diesel oxidation catalyst disposed in the exhaust duct;

a diesel particulate filter disposed in the exhaust duct; and a selective reduction catalyst disposed in the exhaust duct, wherein the downstream diesel oxidation catalyst, the diesel particulate filter and the selective reduction catalyst are disposed serially in the exhaust duct.

10. The system of claim 8, further comprising:

a throttle valve disposed in an intake duct upstream of the first intake duct and a second intake duct; and an electronic control unit electronically coupled to the throttle valve, the EGR valve, and the variable geometry turbine.

11. The system of claim 8 wherein the EGR valve is disposed upstream of the EGR cooler.

12. The system of claim 8 wherein the EGR inlet port is disposed downstream of the compressor.

* * * * *